US005461827A

United States Patent [19]

Lofton

[11] Patent Number: 5,461,827

[45] Date of Patent: Oct. 31, 1995

[54] TELESCOPING WINDOW BAR UNIT

[76] Inventor: Nathan Lofton, 6060 Hwy. 19, Zachary, La. 70791

[21] Appl. No.: 300,269

[22] Filed: Sep. 2, 1994

[51] Int. Cl.[6] ..... E06B 3/68

[52] U.S. Cl. ..... 49/55; 49/56

[58] Field of Search ..... 49/55, 54, 56, 49/50, 51, 64; 52/106

[56] References Cited

U.S. PATENT DOCUMENTS

| | | | |
|---|---|---|---|
| 683,217 | 9/1901 | Mower | 49/55 |
| 2,195,291 | 3/1940 | Zukor | 49/56 X |
| 3,953,439 | 5/1976 | Klein | 49/56 |
| 4,111,477 | 9/1978 | Rigali | 49/56 X |
| 4,452,011 | 6/1984 | Trombettas | 49/56 |
| 4,624,072 | 11/1986 | Zilkha | 49/55 |

*Primary Examiner*—Philip C. Kannan

[57] ABSTRACT

A window bar unit for securing a window and permitting selective opening of the unit for access to an associated window. The inventive device includes an upper grate assembly securable to a window and having a plurality of receiving tubes. A lower grate assembly includes a plurality of telescoping members which slidably extend into the receiving tubes such that the lower grate assembly can be telescopingly positioned within the upper grate assembly to provide access to the window.

5 Claims, 4 Drawing Sheets

TELESCOPING WINDOW BAR UNIT

BACKGROUND OF THE INVENTION

1. Field of the Invention

The present invention relates to window securing structures and more particularly pertains to a telescoping window bar unit for securing a window and permitting selective opening of the unit for access to an associated window.

2. Description of the Prior Art

The use of window securing structures is known in the prior art. More specifically, window securing structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art window securing structures include U.S. Pat. No. 4,476,957; U.S. Pat. No. 4,243,090; U.S. Pat. No. 4,000,590; U.S. Pat. No. 3,913,957; and U.S. Pat. No. 3,953,939.

While these devices fulfill their respective, particular objectives and requirements, the aforementioned patents do not disclose a window bar unit for securing a window which includes an upper grate assembly having a plurality of receiving tubes, and a lower grate assembly having a plurality of telescoping members slidably extending into the receiving tubes such that the lower grate assembly can be telescopingly positioned within the upper grate assembly to provide access to the associated window.

In these respects, the telescoping window bar unit according to the present invention substantially departs from the conventional concepts and designs of the prior art, and in so doing provides an apparatus primarily developed for the purpose of securing a window and permitting selective access to such window.

SUMMARY OF THE INVENTION

In view of the foregoing disadvantages inherent in the known types of window securing structures now present in the prior art, the present invention provides a new telescoping window bar unit construction wherein the same can be utilized for releasably securing a window. As such, the general purpose of the present invention, which will be described subsequently in greater detail, is to provide a new telescoping window bar unit apparatus and method which has many of the advantages of the window securing structures mentioned heretofore and many novel features that result in a telescoping window bar unit which is not anticipated, rendered obvious, suggested, or even implied by any of the prior art window securing structures, either alone or in any combination thereof.

To attain this, the present invention generally comprises a window bar unit for securing a window and permitting selective opening of the unit for access to an associated window. The inventive device includes an upper grate assembly securable to a window and having a plurality of receiving tubes. A lower grate assembly includes a plurality of telescoping members which slidably extend into the receiving tubes such that the lower grate assembly can be telescopingly positioned within the upper grate assembly to provide access to the window.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new telescoping window bar unit apparatus and method which has many of the advantages of the window securing structures mentioned heretofore and many novel features that result in a telescoping window bar unit which is not anticipated, rendered obvious, suggested, or even implied by any of the prior art window securing structures, either alone or in any combination thereof.

It is another object of the present invention to provide a new telescoping window bar unit which may be easily and efficiently manufactured and marketed.

It is a further object of the present invention to provide a new telescoping window bar unit which is of a durable and reliable construction.

An even further object of the present invention is to provide a new telescoping window bar unit which is susceptible of a low cost of manufactured with regard to both materials and labor, and which accordingly is then susceptible of low prices of sale to the consuming public, thereby making such telescoping window bar units economically available to the buying public.

Still yet another object of the present invention is to provide a new telescoping window bar unit which provides in the apparatuses and methods of the prior art some of the advantages thereof, while simultaneously overcoming some of the disadvantages normally associated therewith.

Still another object of the present invention is to provide a new telescoping window bar unit for securing a window and permitting selective opening of the unit for access to an associated window.

Yet another object of the present invention is to provide a new telescoping window bar unit which includes an upper grate assembly having a plurality of receiving tubes, and a lower grate assembly having a plurality of telescoping members slidably extending into the receiving tubes such that the lower grate assembly can be telescopingly positioned within the upper grate assembly to provide access to the associated window.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
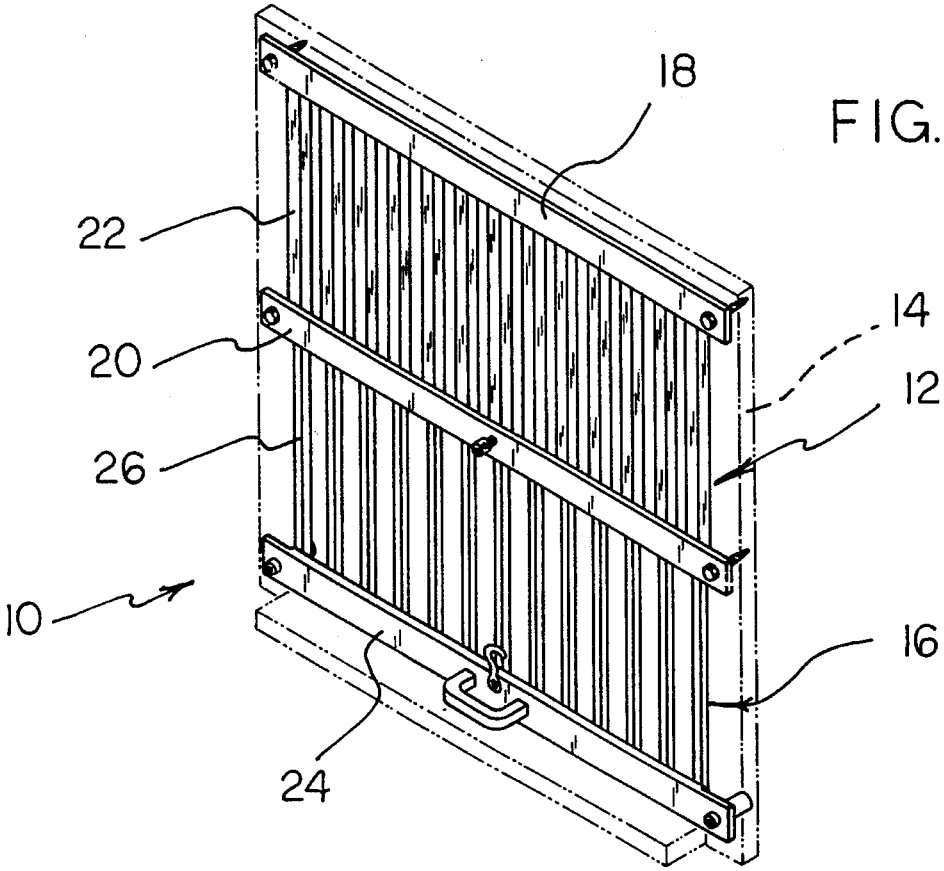
FIG. 1 is an isometric illustration of a telescoping window bar unit according to the present invention as positioned in a closed configuration.

With reference now to the drawings, and in particular to FIGS. 1–8 thereof, a new telescoping window bar unit embodying the principles and concepts of the present invention and generally designated by the reference numeral 10 will be described.

Figure 2:
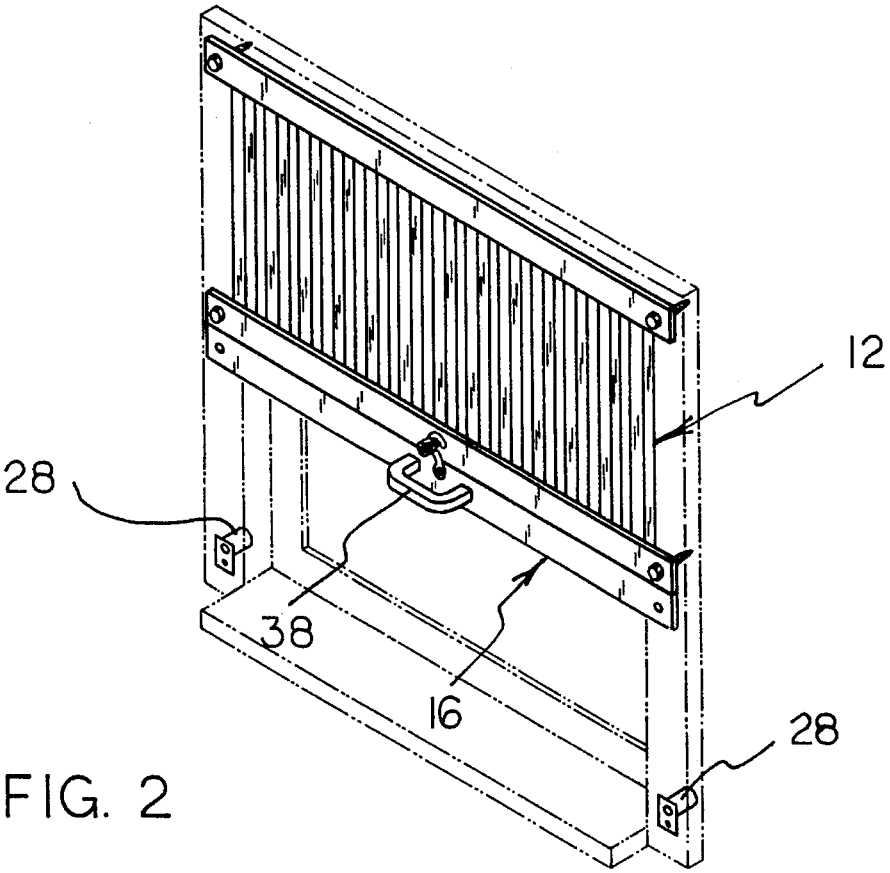
FIG. 2 is a further isometric illustration of the window bar unit positioned in an open orientation.
Figure 3:
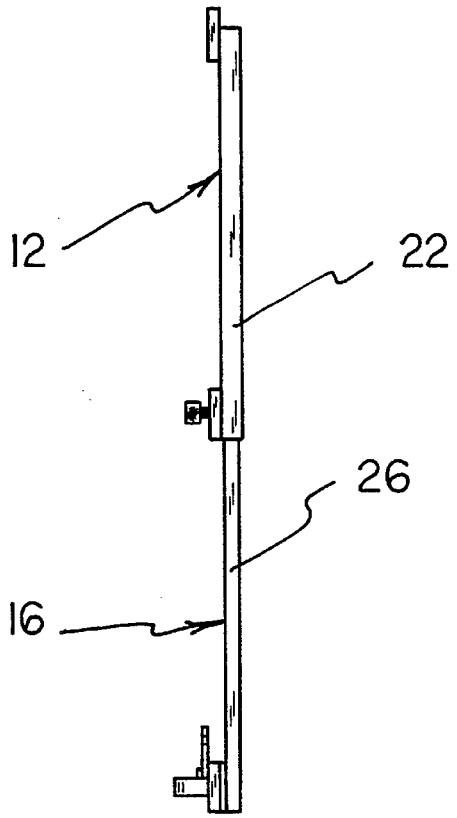
FIG. 3 is a side elevation view of the device.
Figure 4:
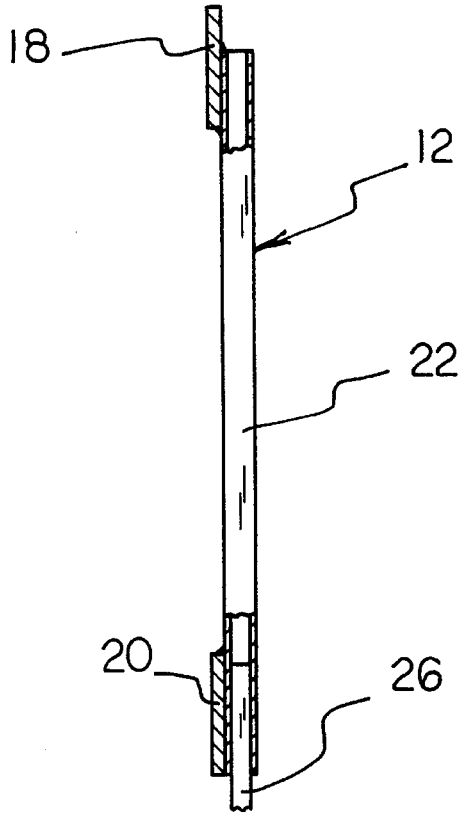
FIG. 4 is a further side elevation view, partially in cross-section, illustrating the reception of the telescoping member into a receiving tube.
Figure 5:
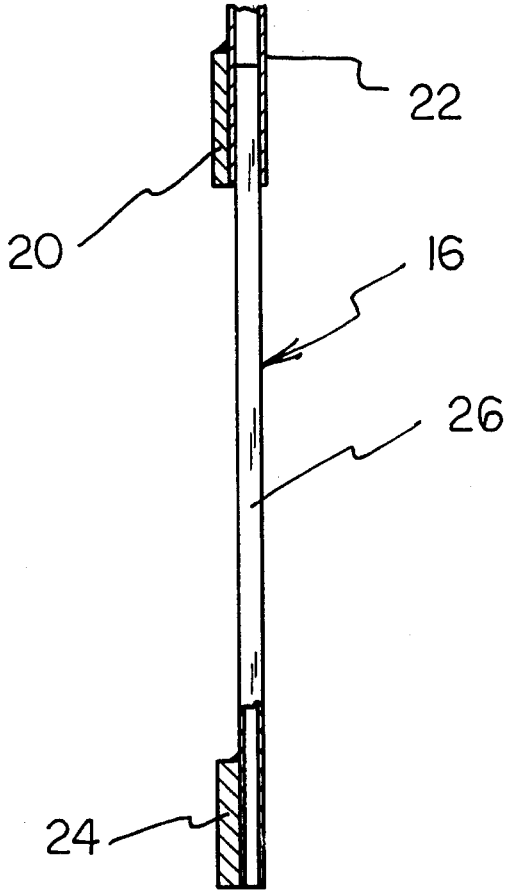
FIG. 5 is a further side elevation view, partially in cross-section further illustrating the reception of the telescoping member within the receiving tube.

More specifically, it will be noted that the telescoping window bar unit 10 comprises an upper grate assembly 12 securable across an upper portion of a window 14 and a lower grate assembly 16 movably mounted relative to the upper grate assembly 12, as best illustrated in FIGS. 1 and 2. The window bar unit 10 is preferably mounted to an interior of the window frame 14 and is operable to be positioned and secured in the closed configuration illustrated in FIG. 1 to preclude entry of unauthorized persons, such as burglars or the like, through the window 14. To provide access to the associated window, the lower grate assembly 16 may be telescopingly moved into the upper grate assembly 12, as shown in FIG. 2, whereby access to the associated window is permitted.

As best illustrated in FIGS. 3 through 6, and with concurrent reference to FIGS. 1 and 2, it can be shown that the upper grate assembly 12 comprises an upper plate 18 securable across an upper portion of the window 14 by a plurality of threaded fasteners, rivets, or other conventionally known fastening means. A medial plate 20 of similar construction relative to the upper plate 18, extends across a medial portion of the window 14 and is similarly secured thereto by a further plurality of threaded fasteners or the like. The upper grate assembly 12 further comprises a plurality of receiving tubes 22 which are fixedly secured to both the upper plate 18 and the medial plate 20 and arranged in a substantially parallel, spaced relationship relative to one another. Preferably, the receiving tubes 22 are positioned along an interior surface of the upper plate 18 and the medial plate 20 so as to be positioned between the plates and the associated window 14. However, it is within the intent and purview of the present invention to fixedly secure the receiving tubes 22 to the exterior of the plates 18, 20 if so desired.

Figure 6:
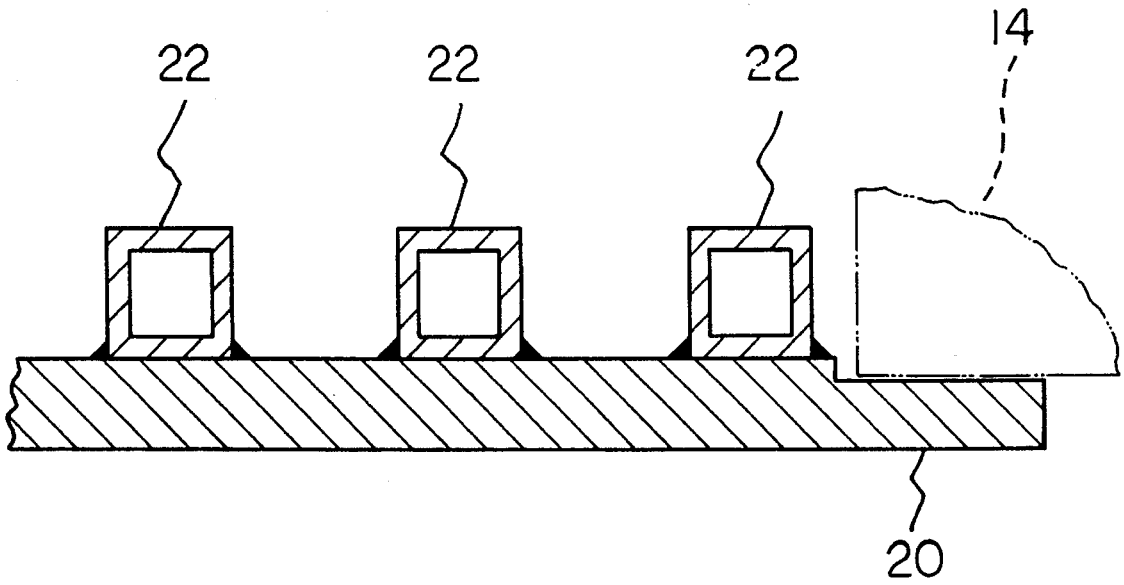
FIG. 6 is a cross-sectional illustration of an upper grate assembly of the present invention.

With continuing reference to FIGS. 1 through 6, it can be shown that the lower grate assembly 16 comprises a lower plate 24 of substantially similar construction to the upper plate 18 and the medial plate 20, with a plurality of telescoping members 26 being fixedly secured to the lower plate 24 and extending into the receiving tubes 22 of the upper grate assembly 12. Thus, the telescoping members 26 are accordingly positioned in a corresponding spaced, and parallel relationship relative to the receiving tubes 22. By this structure, the lower grate assembly 16 is slidably mounted relative to the upper grate assembly 12 and can be positioned in the closed configuration illustrated in FIG. 1, or slidably positioned into the upper grate assembly 12 to orient the device 10 in the open configuration illustrated in FIG. 2. Preferably, the receiving tubes 22, as shown in FIG. 6, have a substantially square cross-section, with the telescoping members 26 being correspondingly shaped so as to fit within the receiving tubes. However, the present invention may be constructed utilizing receiving tubes 22 and telescoping members 26 of any cooperative cross-sectional shape, such as circular, oval, polygonal, or the like.

Figure 7:
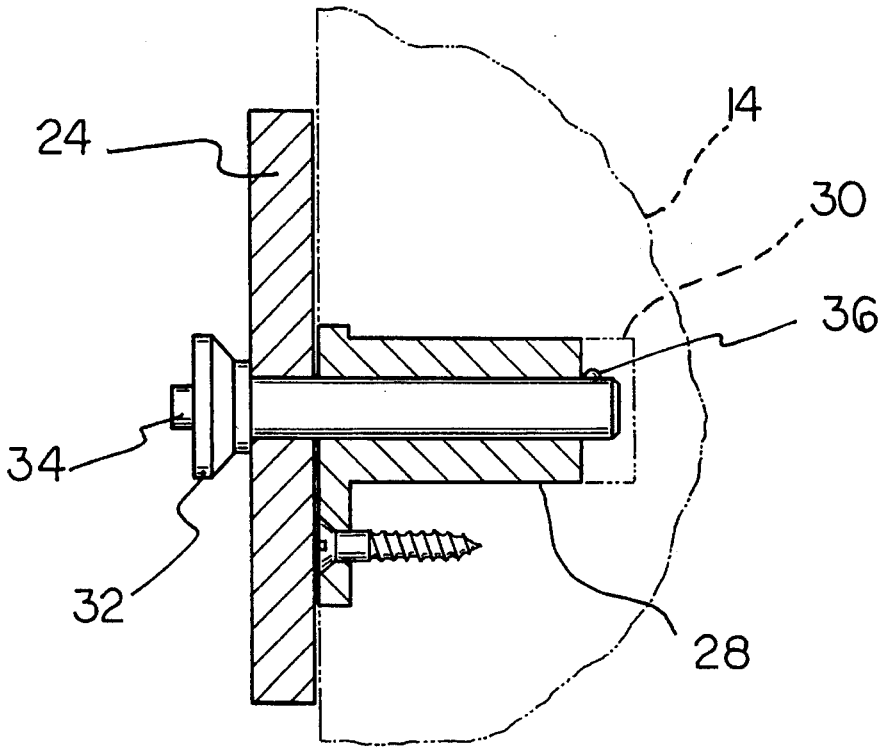
FIG. 7 is a further cross-sectional view illustrating a locking pin engaged to a pin anchor for securing the lower grate assembly in the closed configuration.

Turning now to FIG. 7, with concurrent reference to FIGS. 1 and 2, the present invention 10 additionally comprises at least one pin anchor 28 positionable within a bore 30 formed in the surrounding window structure 14. The pin anchor 28 is operable to receive a locking pin 32 directed through an unlabelled aperture in the lower plate 24 and releasably engaged to the pin anchor, thereby locking the lower plate 24 in the closed configuration illustrated in FIG. 1. To this end, the locking pin 32 includes a spring loaded push button 34 operable to permit or preclude movement of the detent ball 36 projecting from an inner distal end of the locking pin 32 which engages an interior portion of the pin anchor 28 to lock the locking pin 32 therewithin. By this structure, the locking pin 32 is operable to securely fasten the window bar unit 10 in the closed configuration. Such locking pins are conventional in the art and are disclosed throughout the patent literature.

Figure 8:
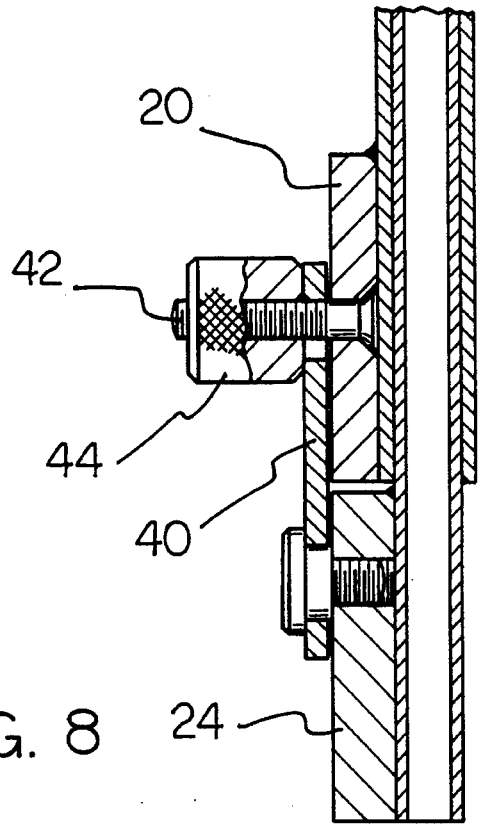
FIG. 8 is a further cross-sectional view illustrating a latch engaged into a locking knob for securing the lower grate assembly in the open configuration.

As shown in FIGS. 2 and 8, the present invention 10 includes a handle 38 secured to the lower plate 24 of the lower grate assembly 16 which may be utilized, after removal of the locking pins 32 from the lower plate, to effect manual raising of the lower grate assembly 16 relative to the upper grate assembly 12. A latch 40 is pivotally mounted to the lower plate 24, as shown in FIG. 8, and can be selectively engaged to a threaded stud 42 projecting from the medial plate 20. A locking knob 44 is threadably engaged to the threaded stud 42 and may be tightened to capture the latch 40 between the medial plate 20 and an interior surface of the locking knob 44. By this structure, the lower grate assembly 16 may be releasably secured in the open configuration illustrated in FIG. 2, whereby tightening of the locking knob 44 will ensure against unintentional release of the latch 40 from the threaded stud 42.

In use, the telescoping window bar unit 10 may be installed to either an interior or exterior of an associated window 14. Preferably, the window bar unit 10 is installed to an interior surface of the window 14, whereby the window is substantially blocked by the upper grate assembly 12 and the lower grate assembly 16 when the device 10 is positioned in the closed configuration. However, when it becomes desirable to access the window 14 the lower grate assembly 16 can be slidably positioned into the upper grate assembly 12, as shown in FIG. 2, to permit such access.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A telescoping window bar unit comprising:

an upper grate assembly means securable across an upper portion of a window for blocking access to said upper portion of said window;

a lower grate assembly means movably mounted relative to said upper grate assembly for blocking a lower portion of said window;

said upper grate assembly means comprising an upper plate securable across said upper portion of said window, a medial plate securable across a medial portion of said window, a plurality of receiving tubes fixedly secured to both said upper plate and said medial plate and arranged in a substantially parallel spaced relationship relative to one another;

said lower grate assembly means comprising a lower plate, a plurality of telescoping members fixedly secured to said lower plate and extending into said receiving tubes of said upper grate assembly means; and at least one pin anchor positionable within a bore formed in structure surrounding said window and a locking pin directed through an aperture in said lower plate and releasably engaged to said pin anchor.

2. The telescoping window bar unit of claim 1, wherein said locking pin includes a detent ball movably mounted at a distal end thereof; and a push button operable to both permit and preclude movement of said detent ball relative to said locking pin, whereby said detent ball projects from said distal end of said locking pin to engage an interior portion of said pin anchor to lock said locking pin therewithin so as to releasably secure said lower grate assembly means in a closed configuration relative to said window.

3. The telescoping window bar unit of claim 2, and further comprising a handle secured to said lower plate of said lower grate assembly means for permitting manual raising of said lower grate assembly means relative to said upper grate assembly means.

4. The telescoping window bar unit of claim 3, and further comprising a latch pivotally mounted to said lower plate; a threaded stud projecting from said medial plate; and a locking knob threadably engaged to said threaded stud, whereby said latch can be positioned into engagement with said threaded stud and said locking knob can be tightened to capture said latch between said medial plate and an interior surface of said locking knob.

5. A telescoping window bar unit comprising:

an upper grate assembly means securable across an upper portion of a window for blocking access to said upper portion of said window, said upper grate assembly means comprising an upper plate securable across said upper portion of said window; a medial plate securable across a medial portion of said window; and a plurality of receiving tubes fixedly secured to both said upper plate and said medial plate and arranged in a substantially parallel, spaced relationship relative to one another;

a lower grate assembly means movably mounted relative to said upper grate assembly for blocking a lower portion of said window, said lower grate assembly means comprising a lower plate; a plurality of telescoping members fixedly secured to said lower plate and extending into said receiving tubes of said upper grate assembly means, said receiving tubes being substantially square in cross-section, with said telescoping members being correspondingly shaped so as to fit within said receiving tubes;

at least one pin anchor positionable within a bore formed in structure surrounding said window; and a locking pin directed through an aperture in said lower plate and releasably engaged to said pin anchor, said locking pin including a detent ball movably mounted at a distal end thereof; and a push button operable to both permit and preclude movement of said detent ball relative to said locking pin, whereby said detent ball projects from said distal end of said locking pin to engage an interior portion of said pin anchor to lock said locking pin therewithin so as to releasably secure said lower grate assembly means in a closed configuration relative to said window;

a handle secured to said lower plate of said lower grate assembly means for permitting manual raising of said lower grate assembly means relative to said upper grate assembly means;

and, a latch pivotally mounted to said lower plate; a threaded stud projecting from said medial plate; and a locking knob threadably engaged to said threaded stud, whereby said latch can be positioned into engagement with said threaded stud and said locking knob can be tightened to capture said latch between said medial plate and an interior surface of said locking knob.

* * * * *